US008375636B2

(12) United States Patent
Nixon

(10) Patent No.: US 8,375,636 B2
(45) Date of Patent: Feb. 19, 2013

(54) ADJUSTABLE SPINDLE ARRANGEMENT FOR DOOR OPERATING APPARATUS RETROFIT KIT

(75) Inventor: Angelo Nixon, Carlsbad, CA (US)

(73) Assignee: Opcon International Holdings, L.P., Pittsburgh, PA (US)

( * ) Notice: Subject to any disclaimer, the term of this patent is extended or adjusted under 35 U.S.C. 154(b) by 0 days.

(21) Appl. No.: 13/314,543

(22) Filed: Dec. 8, 2011

(65) Prior Publication Data

US 2012/0085035 A1 Apr. 12, 2012

Related U.S. Application Data

(62) Division of application No. 12/107,018, filed on Apr. 21, 2008, now Pat. No. 8,091,283.

(60) Provisional application No. 60/925,644, filed on Apr. 20, 2007.

(51) Int. Cl.
*E05F 15/02* (2006.01)

(52) U.S. Cl. ..... 49/334; 49/333

(58) Field of Classification Search ..... 49/333, 49/334, 335, 336, 337
See application file for complete search history.

(56) References Cited

U.S. PATENT DOCUMENTS

| | | | | |
|---|---|---|---|---|
| 1,129,391 | A * | 2/1915 | Hohne et al. | 49/30 |
| 1,367,931 | A * | 2/1921 | Varnum | 49/139 |
| 4,220,051 | A | 9/1980 | Catlett | |
| 4,599,824 | A | 7/1986 | Mitsuhashi et al. | |
| 5,036,620 | A * | 8/1991 | Beran et al. | 49/141 |
| 5,193,647 | A | 3/1993 | O'Brien | |
| 5,417,011 | A * | 5/1995 | Keszthelyi | 49/334 |
| 6,026,720 | A | 2/2000 | Swank | |
| 6,108,975 | A * | 8/2000 | Bailey | 49/334 |
| 6,176,044 | B1 | 1/2001 | Nixon et al. | |
| 6,234,024 | B1 | 5/2001 | Brunty et al. | |
| 7,228,659 | B2 | 6/2007 | Romero et al. | |
| 7,513,078 | B2 * | 4/2009 | Ho | 49/334 |
| 7,816,875 | B2 | 10/2010 | Taheri et al. | |
| 8,091,283 | B2 * | 1/2012 | Nixon | 49/335 |
| 2008/0256870 | A1 * | 10/2008 | Nixon | 49/334 |
| 2010/0278602 | A1 | 11/2010 | Clark, II et al. | |

FOREIGN PATENT DOCUMENTS

| | | |
|---|---|---|
| GB | 2265180 | 9/1993 |

* cited by examiner

*Primary Examiner* — Jerry Redman
(74) *Attorney, Agent, or Firm* — Jonathan C. Parks, Esq.; Pietragallo Gordon Alfano Bosick & Raspanti, LLP

(57) ABSTRACT

A retrofit conversion kit for facilitating the conversion of a door operating apparatus conventionally mounted above the door, to a position mounted and anchored underground for operating a swinging door therefrom. The conversion to an anchored underground position is facilitated by incorporating positional adjustment mechanisms covering any or all possible adjustment dimensions.

4 Claims, 3 Drawing Sheets

ADJUSTABLE SPINDLE ARRANGEMENT FOR DOOR OPERATING APPARATUS RETROFIT KIT

CLAIM OF PRIORITY

This application claims priority to U.S. application Ser. No. 12/107,018, filed on Apr. 21, 2008, now U.S. Pat. No. 8,091,283, which claims priority to U.S. Provisional Application No. 60/925,644, filed on Apr. 20, 2007.

FIELD OF INVENTION

The invention relates generally to door operating apparatuses and door operating systems for operating swinging doors and, more particularly, to kits for retrofitting door operating apparatuses and their associated door operating systems, particularly for building ingress and egress doors.

BACKGROUND

Automatic doors are doors that are powered open or powered closed or both. If an automatic door is powered open only, then, it is conventionally spring closed or hydraulically closed. Automatic doors conventionally employ a sensor or switch to activate the door. The sensor detects approaching traffic and may be a motion sensor, infrared sensor, or pressure sensor. The switch is conventionally operated manually and may take the form of a push button, swipe card, or other available switch type access or security system. Alternatively the switch may be activated by pushing or pulling the door, so that once the door detects the movement it completes the open and close cycle. These are also known as power-assisted doors.

Swinging doors are hinged and pivot around an axis in an inward or outward direction or both. Automatic swinging doors are coupled to a source of torque, that is, a door operating apparatus, for providing the force necessary to pivot the door open or closed or both. Most commercially available door operating apparatuses are electromechanical or electro-hydraulic and are positioned above the door in an overhead position for ease and economy of installation. Most commercially available door operating apparatuses are spring closed.

U.S. Pat. No. 6,176,044 (incorporated herein by reference) discloses a kit and method for retrofitting electromechanical door operating apparatuses. The retrofit kit shown in this patent is employable for converting a door operating apparatus for operating a swinging door from overhead use to underground use. The retrofit kit has had general success in the market place.

Automatic doors are differentiated from manual closers by the fact that manual closers are passive rather than active. A manual closer is a door that includes a manual door closer, that is, a passive device for closing the door. The manual door closer employs a combination of a hydraulic damping system and a spring closing system to self-close the door after a person or thing first manually pushes or pulls the door open. A manual closer is not opened automatically and therefore cannot open by itself. The hydraulic damping system regulates the force required to manually push or pull a door open and regulates the speed at which a door self-closes. Manual door closers may be mounted overhead within a door frame, or on the upper face of a door or frame, or below the door in an underground or sub-floor stratum. An automatic door operator may be employed as a door closer, but a manual door closer can not be employed as an automatic door operator. Manual door closers are passive and do not include electronic components. Some "Medium to Light Duty" manual door closers designed for use in a sub-floor stratum include a mechanism for adjusting the coupling between the door arm and the manual door closer once the manual door closer is cemented in its sub-floor stratum. More particularly, these manual door closers include a mechanism for moving the entire body of the closer in a vertical or horizontal direction to meet the location of the door arm above. The upward movement of this adjustment is constrained when the upward movement causes the closer to contact the threshold or finished floor above the closer. Lateral movements of this adjustment are similarly constrained by the height of the closer relative to the spindle height. Horizontal movement is limited by the threshold or finished floor condition above the closer. Mechanisms for independently adjusting the height of the door closer spindle without raising or lowering the entire body of the manual door closer are unknown. Also, retrofit kits for converting overhead manual door closers to underground manual door closers are unknown.

A manual closer has been converted to an automatic door operator by combining a manual door closer with a hydraulic operating system. A hydraulic operating system employable for this conversion is the Tormax™ Model TN (To ax is registered trademark of Landert Motoren AG, Bülach-Zürich, Switzerland). The Model TN is a floor mounted door operator and is manufactured as an automatic door operator. The Model TN is not an automatic door operator "conversion system" or kit, it is an automatic door operator. The Model TN is an underground hydraulic closer with a remotely mounted electric pump system that pushes hydraulic fluid within a floor closer to apply torque to a spindle that is rotationally coupled to a door. The pump system and electronics are mounted remotely and are not mounted underground. The Model TN is cemented within a sub-floor stratum and, once it is anchored within the sub-floor stratum, can not be repositioned so as to align the spindle with the door arm. The Model TN lacked a mechanism for re-aligning the spindle after the door operator has been cemented or anchored within its sub-floor stratum. The Model TN requires precise alignment of its spindle with the desired position of the door arm when the device is installed beneath the floor. Alignment adjustments for the Model TN are not available after the device is cemented in place.

SUMMARY OF INVENTION

The invention is directed to a kit for retrofitting door operating apparatuses from overhead use to underground use in an anchored sub-floor stratum and by facilitating this conversion by incorporating positional adjustment mechanisms covering any or all possible adjustment dimensions. The invention facilitates the alignment of the door operating apparatus with the door arm after the door operating apparatus has been cemented in place within its sub-floor stratum so that the desired door alignment can be achieved. The invention is also directed to processes that employ the positional adjustment mechanisms of the kit.

BRIEF DESCRIPTION OF DRAWING

The objects, advantages, and features of the invention, as shown in the exemplary embodiments, will be more clearly perceived from the following description, when read in conjunction with the accompanying drawing, in which.

DETAILED DESCRIPTION OF PREFERRED EMBODIMENTS

Figure 1:
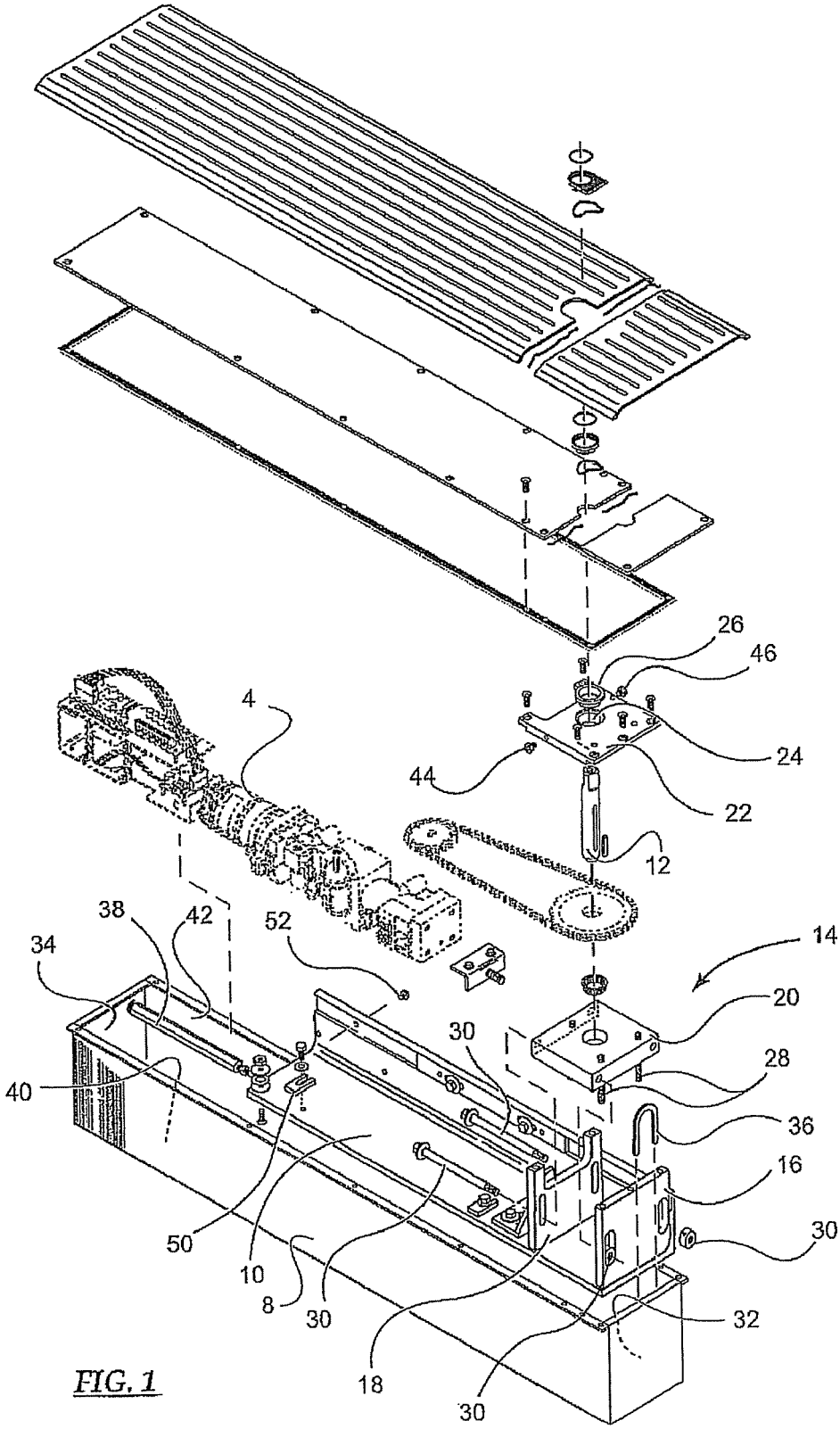
FIG. 1 is an exploded perspective view illustrating both a door operating apparatus and a door operating system (shown in phantom) and all components of an exemplary kit for retrofitting both the door operating apparatus and door operating system to underground use, illustrating all components of the exemplary kit that serve as positional adjustment mechanisms.
Figure 2:
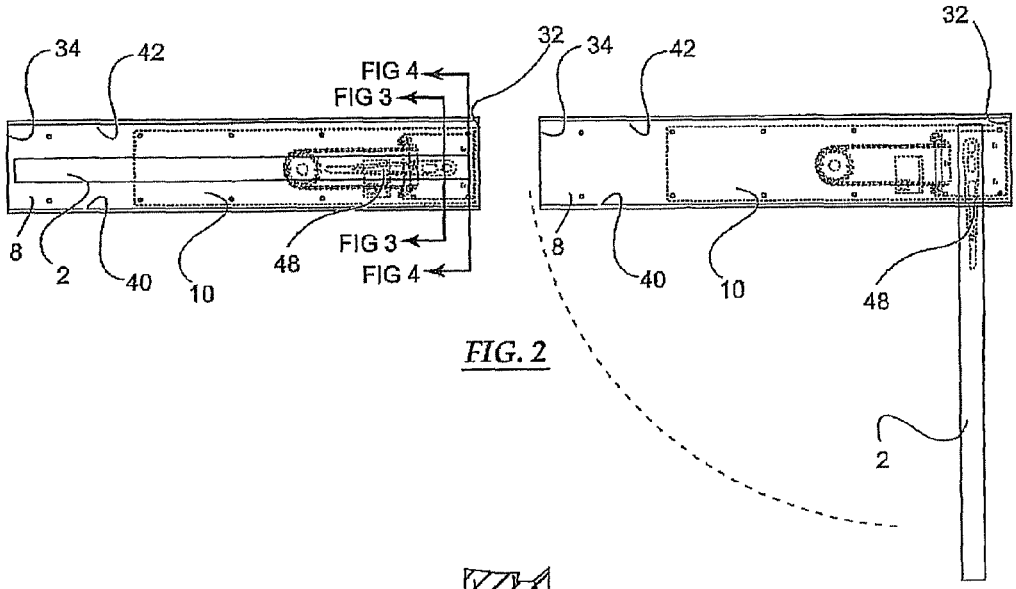
FIG. 2. is a two part planar overhead view illustrating opened and closed positions of a door, a door arm, and a retrofitted door operating apparatus, in accordance with the invention.

One aspect of the invention is directed to a retrofit conversion kit with vertical adjustment for coupling a door (2) to an automatic door operator (4) from a sub-floor stratum (6) or from an above door position. The conversion kit comprises an enclosure (8), a sled (10), a spindle (12), and a spindle housing (14). The enclosure (8) is for containing the automatic door operator (4) and is anchorable within the sub-floor stratum (6) or securable in the above door position. The sled (10) serves for mounting and securing the automatic door operator (4) thereonto. The sled (10), in turn, is mountable and enclosable within the enclosure (8). The spindle (12) is adapted for rotationally engaging the automatic door operator (4) within the enclosure (8) and for vertically and rotationally engaging the door (2) both for providing vertical support to the door (2) and for transmitting torque from the automatic door operator (4) to the door (2). The spindle housing (14) is also attached to the sled (10) and serves to secure the spindle (12). The spindle housing (14) includes a front vertical plate (16) attached to the sled (10), a back vertical plate (18) attached to the sled (10), a bearing plate (20) secured by the front and back vertical plates (16 and 18) for bearing the spindle (12), and a top plate (22). The top plate (22) defines a passage (24) therein adapted for passage of the spindle (12) therethrough. The passage (24) has a bushing (26) therein for providing lateral support to the spindle (12). The bearing plate (20) is slideably secured by the front and back vertical plates (16 and 18) and has an adjustable vertical position within the spindle housing (14) for adjusting the vertical position of the spindle (12) borne thereon. Adjusting the vertical position of the spindle (12) facilitates the vertical and rotational engagement of the spindle (12) to the door (2).

In a first preferred embodiment of this first aspect of the invention, the bearing plate (20) defines one or more threaded screw holes and the spindle housing (14) further includes one or more vertical adjustment screws (28). Each vertical adjustment screw (28) is engagable to a corresponding threaded screw hole defined by the bearing plate (20) and is rotatable therein for adjusting the vertical position of the bearing plate (20) and the spindle (12) borne thereon. In a variant of the first preferred embodiment, the spindle housing (14) further includes one or more horizontal fasteners (30) for securing and de-securing the bearing plate (20) to the front and back vertical plates (16 and 18). The horizontal fasteners (30) are of a type that is capable of being fastened and unfastened for securing and de-securing the bearing plate (20) to the front and back vertical plates (16 and 18) when adjusting the vertical position of the bearing plate (20) by means of the vertical adjustment screws (28).

In a second preferred embodiment of this first aspect of the invention, the enclosure (8) has a conformation with a longitudinal dimension, the longitudinal dimension extending in a horizontal direction from a first end (32) to a second end (34). The sled (10) is slideably securable within the longitudinal dimension of the enclosure (8) for longitudinal adjustment of the spindle (12). The retrofit conversion kit further comprises an optional shim (36) and a longitudinal adjustment rod (38). The optional shim (36) is selected from a group of variably sized shims having a composition of plastic or other common shim material for wedging between the spindle housing (14) and the first end (32) of the longitudinal dimension of the enclosure (8). The longitudinal adjustment rod (38) is attached to the sled (10) and has an adjustable length for contacting the second end (34) of the longitudinal dimension of the enclosure (8). The longitudinal position of the sled (10), the spindle housing (14) and spindle borne thereon can be secured within the enclosure (8) by selecting one of the optional shims (36) of desired size, wedging the shim (36) between the spindle housing (14) and the first end (32) of the longitudinal dimension of the enclosure (8), and then adjusting the length of the longitudinal adjustment rod (38) for contacting the second end (34) of the enclosure (8) for tightening the spindle housing (14) against the shim (36) and the shim (36) against the first end (32) of the enclosure (8).

In a third preferred embodiment of this first aspect of the invention, the enclosure (8) has a conformation with a lateral dimension, the lateral dimension extending in a horizontal direction from a first side (40) to a second side (42). The sled (10) is slideably securable within the lateral dimension of the enclosure (8) for lateral adjustment of the spindle (12). The retrofit conversion kit further comprises a first lateral adjustment screw (44) and a second lateral adjustment screw (46). The top plate (22) defines a first threaded screw hole adapted for accepting the first lateral adjustment screw (44) and a second threaded screw hole adapted for accepting the second lateral adjustment screw (46). The first lateral adjustment screw (44), when screwed into the first screw hole is adapted for contacting the first side (40) of the lateral dimension of the enclosure (8). The second lateral adjustment screw (46), when screwed into the second screw hole is adapted for contacting the second side of the lateral dimension of the enclosure (8). The lateral position of the sled (10), the spindle housing (14) and spindle (12) borne thereon are securable within the enclosure (8) by adjustment of the first and second lateral adjustment screws (44 and 46).

A second aspect of the invention is directed to a retrofit conversion kit with longitudinal adjustment for coupling an automatic door operator (4) to a door (2) for operating the door (2) from a sub-floor stratum (6) or from an above door position. The retrofit conversion kit comprises an enclosure (8), a spindle (12), a spindle housing (14), and a sled (10). The enclosure (8) serves to contain the automatic door operator (4). The enclosure (8) is anchorable within the sub-floor stratum (6) or is securable in the above door position and has a conformation with a longitudinal dimension. The longitudinal dimension extends in a horizontal direction from a first end (32) to a second end (34). The spindle (12) is adapted for rotationally engaging the automatic door operator (4) within the enclosure (8) and for vertically and rotationally engaging the door (2) both for providing vertical support to the door (2) and for transmitting torque from the automatic door operator (4) to the door (2). The spindle housing (14) serves to support the spindle (12). The sled (10) is enclosable within the enclosure (8) and serves to secure the automatic door operator (4) and the spindle housing (14) therein. The sled (10) has a first end for orienting with the first end (32) of the enclosure (8) and a second end (34) for orienting with the second end (34) of the enclosure (8). The spindle housing (14) is attached proximal to first end of the sled (10). The automatic door operator (4) is attached proximal to the second end (34) of the sled (10). The sled (10) is slideably securable within the longitudinal dimension of the enclosure (8) for adjusting the longitudinal position of the spindle (12).

In a preferred embodiment of this second aspect of the invention, the retrofit conversion kit further comprises an optional shim (36) and a longitudinal adjustment rod (38). The optional shim (36) is selected from a group of variably sized shims having a composition of plastic or other common shim material for wedging between the spindle housing (14) and the first end (32) of the longitudinal dimension of the enclosure (8). The longitudinal adjustment rod (38) is attached to the sled (10) and has an adjustable length for contacting the second end (34) of the longitudinal dimension of the enclosure (8). The longitudinal position of the sled (10) and of the attached spindle housing (14) and spindle (12) borne thereon is secured within the enclosure (8) by selecting one of the optional shims of desired size, wedging the shim (36) between the spindle housing (14) and the first end (32) of the longitudinal dimension of the enclosure (8), and then adjusting the length of the longitudinal adjustment rod (38) for contacting the second end (34) of the longitudinal dimension of the enclosure (8) and tightening the spindle housing (14) against the shim (36) and the first end (32) of the longitudinal dimension of the enclosure (8).

A third aspect of the invention is directed to a retrofit conversion kit with lateral adjustment for coupling an automatic door operator (4) to a door (2) for operating the door (2) from a sub-floor stratum (6) or from an above door position. The conversion kit comprises an enclosure (8), a spindle (12), a spindle housing (14), and a sled (10). The enclosure (8) serves to contain the automatic door operator (4). The enclosure (8) is anchorable within the sub-floor stratum (6) and has a conformation with a lateral dimension. The lateral dimension extends in a horizontal direction from a first side (40) to a second side (42). The spindle (12) is adapted for rotationally engaging the automatic door operator (4) within the enclosure (8) and for vertically and rotationally engaging the door (2) both for providing vertical support to the door (2) and for transmitting torque from the automatic door operator (4) to the door (2). The spindle housing (14) serves to support the spindle (12). The sled (10) is enclosable within the enclosure (8) for securing the automatic door operator (4) and the spindle housing (14) therein. The sled (10) has a first side corresponding to the first side (40) of the enclosure (8) and a second side corresponding the second side (42) of the enclosure (8). The spindle housing (14) is attached to the sled (10). The sled (10) is slideably securable within the lateral dimension of the enclosure (8) for lateral adjustment of the spindle (12).

In a preferred embodiment of this third aspect of the invention, the retrofit conversion kit further comprises a first lateral adjustment screw (44) and a second lateral adjustment screw (46). The top plate (22) defines a first threaded screw hole adapted for accepting the first lateral adjustment screw (44) and a second threaded screw hole adapted for accepting the second lateral adjustment screw (46). The first lateral adjustment screw (44), when screwed into the first screw hole is adapted for contacting the first side (40) of the lateral dimension of the enclosure (8). The second lateral adjustment screw (46), when screwed into the second screw hole is adapted for contacting the second side (42) of the lateral dimension of the enclosure (8). The lateral position of the sled (10), the spindle housing (14) and spindle (12) borne thereon are securable within the enclosure (8) by adjustment of the first and second lateral adjustment screws (44 and 46).

A fourth aspect of the invention is directed to a process with vertical adjustment for coupling a door (2) to an automatic door operator (4) from a sub-floor stratum (6) or from an above door position. The process comprises multiple steps. In an anchoring step, a lower portion of an enclosure (8) is anchored within the sub-floor stratum (6). In an attaching step, the automatic door operator (4) and a coupling device are attached to a sled (10). The automatic door operator (4) and the coupling device are rotationally coupled to one another. The coupling device includes a spindle (12) for rotationally coupling to the door (2). In an installing step, the sled (10) is installed within the lower portion of the enclosure (8). Then, in an adjusting step, the vertical height of the spindle (12) is adjusted to accommodate the coupling of the spindle with the door (2). Then, in an engaging step, the spindle (12) is vertically and rotationally engaged with the door (2) for providing vertical support to the door (2) and for transmitting torque from the automatic door operator (4) to the door (2) via the spindle (12).

A fifth aspect of the invention is directed to a process with horizontal adjustment for coupling a door (2) to an automatic door operator (4) from a sub-floor stratum (6) or from an above door position. The process comprises multiple steps. In an anchoring step, a lower portion of an enclosure (8) is anchored within the sub-floor stratum (6). In an attaching step, the automatic door operator (4) and a coupling device are attached to a sled (10). The automatic door operator (4) and the coupling device are rotationally coupled to one another. The coupling device includes a spindle (12) for rotationally coupling to the door (2). In an installing step, the sled (10) is installed within the lower portion of the enclosure (8). Then, in an aligning step, the spindle (12) is aligned with the door (2) by repositioning the sled (10) within the enclosure (8) and securing the repositioned sled (10) within the enclosure (8). Then, in an engaging step, the spindle (12) is vertically and rotationally engaged with the door (2) for providing vertical support to the door (2) and for transmitting torque from the automatic door operator (4) to the door (2).

In a first preferred mode of this fifth aspect of the invention, the enclosure (8) is of a type having a longitudinal dimension and, in the aligning step, the sled (10) is aligned along the longitudinal dimension.

In a variation of the first mode of this fifth aspect of the invention, after the completion of the anchoring, attaching, and installing steps, the process additionally includes an adjusting step by which the vertical height of the spindle (12) is adjusted to accommodate the coupling of the spindle (12) with the door (2).

In a second preferred mode of this fifth aspect of the invention, the enclosure (8) is of a type additionally having a lateral dimension and, in the aligning step, the sled (10) is additionally aligned along the lateral dimension.

In a variation of the second mode of this fifth aspect of the invention, after the completion of the anchoring, attaching, and installing steps, the process additionally includes an adjusting step by which the vertical height of the spindle (12) is adjusted to accommodate the coupling of the spindle (12) with the door (2).

In a further variation of the second mode of this fifth aspect of the invention, the enclosure (8) is of a type additionally having a longitudinal dimension and, in the aligning step, the sled (10) is additionally aligned along the longitudinal dimension.

EXAMPLE

A preferred example of the invention is a modified version of the retrofit conversion kit disclosed in U.S. Pat. No. 6,176,044 ('044). The '044 patent discloses a kit for converting any manufacturer's overhead mounted swinging door operating apparatus from overhead use to underground use. The present invention is directed to a similar kit except that the kit of the present invention additionally provides positional adjustment mechanisms covering any or all possible adjustment dimensions. More particularly, the present invention includes vertical or lateral or longitudinal positional adjustment mechanisms or any combination thereof for aligning the spindle (12) with the preferred location of the door (2). The spindle (12) defines a male member and the door (2) includes a door arm (48) with a female member. When the door (2) is mounted onto the door operating device, the male member of the spindle (12), which is rotationally coupled to the door operating device, inserts into the female member of the door arm (48). This insertion achieves a coupling between the spindle (12) and the door arm (48), determines the alignment of the door (2) and enables the door operating apparatus to transfer torque to the door arm (48) and hence to the door (2) via the spindle (12). Achievement of the desired alignment between the spindle (12) and the female member of the door arm (48) is essential to properly enable both of these functions. The invention provides positional adjustment mechanisms for achieving this alignment.

Figure 3:
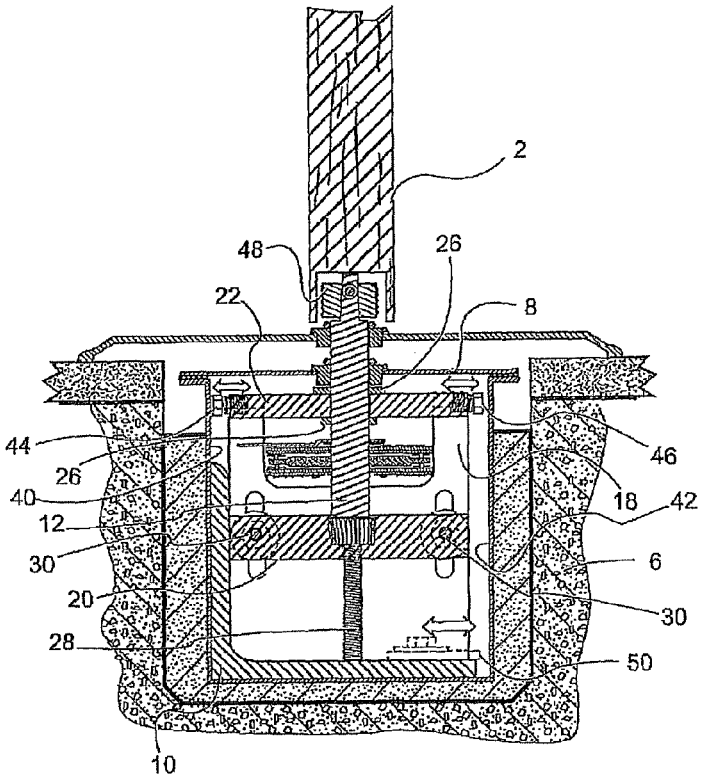
FIG. 3. is a sectional view taken through cutting plane 3-3 of FIG. 2, illustrating two lateral adjustment mechanisms in accordance with the invention.
Figure 4:
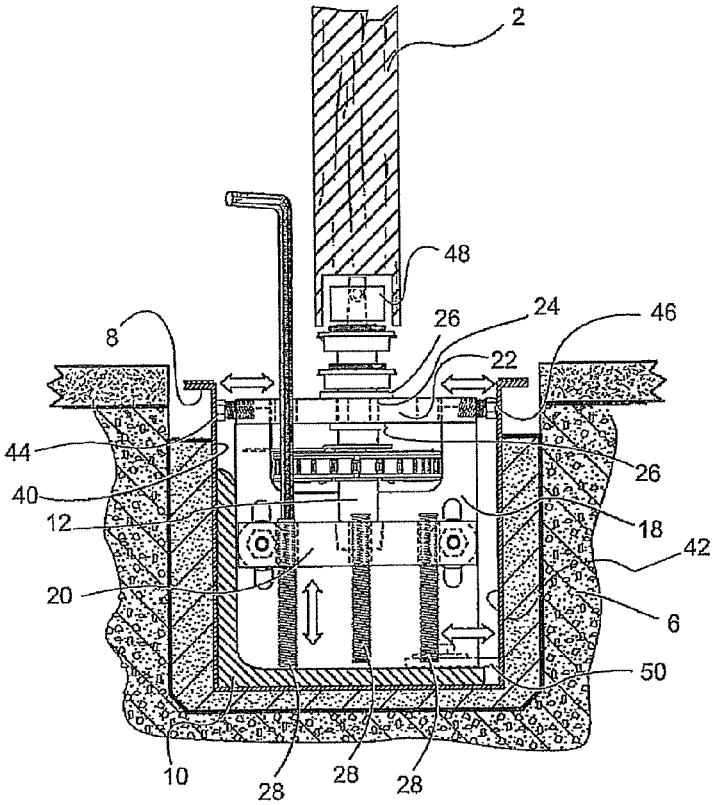
FIG. 4. is a further sectional view taken through cutting plane 4-4 of FIG. 2, illustrating both a vertical adjustment mechanism and a lateral adjustment mechanism, in accordance with the invention.

Exemplary positional adjustment mechanisms for providing vertical adjustments are illustrated in FIGS. 1, 3, and 4. Vertical adjustment screws (28) and horizontal fasteners (30) for securing the bearing plate (20) are illustrated in an exploded view in FIG. 1 and in planar or phantom views in FIGS. 3 and 4. The phantom view of the vertical adjustment screws (28) in FIG. 4 illustrate the vertical adjustment screws (28) passing through threaded holes in the bearing plate (20) of the spindle housing (14). The exploded view of the horizontal fasteners (30) in FIG. 1 and phantom view of the horizontal fasteners (30) in FIGS. 3 and 4 illustrate the horizontal fasteners (30) passing through holes in the bearing plate (20) and through slots in both the front and back vertical plates (16 and 18). FIGS. 1, 3, and 4 also illustrate the fasteners being employed for securing the bearing plate (20) to the front and back vertical plates (16 and 18) by being fastened. In this example, nuts are screwed onto the threaded ends of horizontal bolts and tightened. Conversely, it is clear that the bearing plate (20) can be de-secured from the front and back vertical plates (16 and 18) by unfastening the fasteners.

FIG. 4 also illustrates a procedure for adjusting the height of the bearing plate (20) with respect to the vertical adjustment screws (28). Firstly, the bearing plate (20) is unsecured from the front and back vertical plates (16 and 18) by unfastening the fasteners. Secondly, vertical adjustment screws (28) are rotated by the application of torque. FIG. 4 illustrates the rotation of the left most vertical adjustment screw (28) by application of torque by means of an alien wrench, the subsequent vertical adjustment of the elevation of the bearing plate (20). The procedure is completed by rotating all of the vertical adjustment screws (28) so that the desired height of the bearing plate (20) is achieved and all vertical adjustment screws (28) are in contact with the bottom of the sled (10). During this adjustment procedure, the horizontal fasteners (30) slide vertically within their slots in the front and back vertical plates (16 and 18). After the desired height of the bearing plate (20) is achieved, the bearing plate (20) is re-secured to the front and back vertical plates (16 and 18) by refastening the horizontal fasteners (30).

Figure 5:
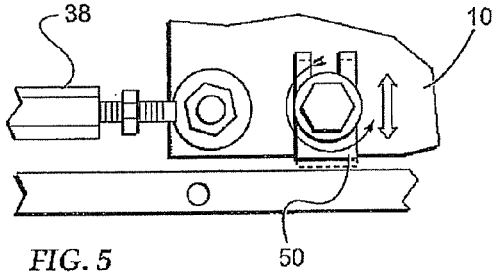
FIG. 5. is a fragment of a planar view from FIG. 1, illustrating both a lateral adjustment mechanism and a fragment of a longitudinal adjustment mechanism, and further illustrating the movement of the lateral adjustment mechanism.
Figure 6:
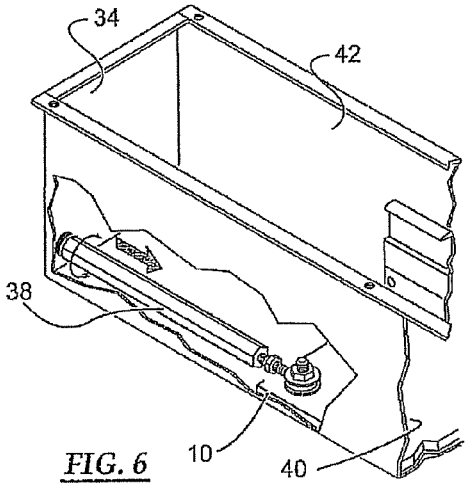
FIG. 6. is a fragment of a perspective view of the longitudinal adjustment mechanism of FIG. 5, illustrating motion of the longitudinal adjustment mechanism and its relationship to the sled and the second end of the enclosure.

Exemplary positional adjustment mechanisms for providing longitudinal adjustments are illustrated in FIGS. 1, 5, and 6. FIG. 1 illustrates an exploded view of a shim (36) and of a longitudinal adjustment rod (38). The shim (36) is shown being wedged between the front vertical plate (16) of the spindle housing (14) and the first end (32) of the enclosure (8). The shim (36) is selected from a group of shims of variable widths and is employed for determining the longitudinal position of the sled (10) and the attached spindle housing (14) and spindle (12). FIG. 6 illustrates the longitudinal adjustment rod (38), the attachment of the longitudinal adjustment rod (38) to the sled (10), the rotational motion of the longitudinal adjustment rod (38). Rotation of longitudinal adjustment rod (38) causes its length to increase or decrease. Increasing the length of the longitudinal adjustment rod (38) causes it to contact the second end (34) of the enclosure (8) as so as to secure the longitudinal position of the sled (10) by pushing the sled (10) and the attached spindle housing (14) against the shim (36) which is wedged between the front vertical plate (16) of the spindle housing (14) and the first end (32) of the enclosure (8). This secures the horizontal position of the spindle (12).

Exemplary positional adjustment mechanisms for providing lateral adjustments are illustrated in FIGS. 1, 3, 4, and 5. First and second lateral adjustment screws (44 and 46) are illustrated in FIGS. 1, 3, and 4. FIG. 1 illustrates the first and second lateral adjustment screws (44 and 46) in exploded form. FIG. 3 illustrates the first and second lateral adjustment screws (44 and 46) in withdrawn position where they have been screwed into screw holes in the top plate (22). In this withdrawn position, they do not contact the first or second sides (40 and 42) of the enclosure (8). FIG. 4 illustrates the first and second lateral adjustment screws (44 and 46) in extended positions where they have been screwed out of their respective screw holes in the top plate (22). The lateral position of the spindle housing and the spindle (12) thereon may be adjusted by adjusting the relative extended positions of the first and second lateral adjustment screws (44 and 46). To secure the lateral position of the spindle housing (14), both the first and second lateral adjustment screws (44 and 46) must contact the side walls of the enclosure (8). FIG. 5 illustrates a lateral adjustment brace (50) mounted onto the sled (10) that is employable for securing the lateral position of the sled. The lateral adjustment brace (50) may be loosened from its mounting on the sled (10) and adjusted so that it contacts the first side (40) of the enclosure (8) when the sled (10) is properly positioned. When proper lateral positioning is achieved, lateral adjustment brace (50) is re-secured to its mounting on the sled (10). A counter balancing screw (52) in the sled (10) is illustrated in FIG. 1 and may be employed for securing the lateral position achieved by the lateral adjustment brace (50).

All of the positional adjustment mechanisms described herein may be used to adjust the spindle position without removing the door (2).

All of the positional adjustment mechanisms described herein may be used with retrofit conversion kits employable either in a sub-floor stratum (6) or in an above door position.

All of the positional adjustment mechanisms described herein are capable of adjusting the position of the spindle (12) without moving the enclosure (8), as was required in the prior art.

All of the positional adjustment mechanisms described herein are capable of adjusting the position of the spindle (12) beyond constraints that can be practically anticipated by the threshold or finished floor condition above the door operating apparatus. For example, longitudinal adjustments can be achieved of up to 12 inches and lateral adjustments of three quarters of an inch. These constraints far exceed what is necessary from a practical basis. Vertical adjustments of up to one and one quarter inch upward or downward from center are achievable. It is important to note that vertical adjustment is extremely important in door installation. The bottom arm (48) of the door (2) (the female component that engages the male spindle (12) may be located at different depths within the bottom of the door (2) of the door panel. This depth may vary from flush to the bottom of the door (2) to as much as two inches within the bottom of the door (2). Sometimes, the bottom arm (48) protrudes beyond the bottom of the door (2) (mainly in retro-fit application). A vertically adjustable spindle (12) is critical to a successful door installation in order minimize the error factor that occurs when matching various manufacturers' door hardware. Excavation depth also affects the vertical distance required for the spindle (12) to bottom arm dimension.

The kit of the present application can also be employed with a sealing arrangement to protect the content of the enclosure. A kit having such a sealing system is described in patent application Ser. No. 12/107,017, now abandoned, entitled "Sealing Arrangement for Door Operating Apparatus Retrofit Kit," filed Apr. 21, 2008, which is incorporated herein by reference.

Definitions

Automatic Door Operator (4): An automated power mechanism rotationally coupled to a door (2) for providing torque for opening or closing such door (2), or both.

Enclosure (8): A container in which the door operating apparatus and automatic door operating system are enclosed. The enclosure (8) has two halves, viz., an upper portion and a lower portion. When installed, the lower portion is cemented in-place or otherwise anchored in a sub-floor stratum (6). The upper portion is a plate that attaches to the lower portion by means of fasteners. The enclosure (8) may also have a conformation with a lateral dimension extending in a horizontal direction and a longitudinal dimension also extending in a horizontal direction. The longitudinal dimension is greater than the lateral dimension. The lateral dimension extends from a first side (40) of the enclosure (8) to a second side (42) of the enclosure (8), in a horizontal direction; the longitudinal dimension extends from a first end (32) of the enclosure (8) to a second end (34) of the enclosure (8), also in a horizontal direction.

Sub-Floor Stratum (6): Any stratum that is sufficiently proximal to a floor surface so as to be subject to moisture and/or dust conditions characteristic of a floor surface.

Spindle (12): A vertical shaft protruding from a door operator (4) that engages a door arm (48) located in the bottom of the door panel (2). Conventionally, the spindle (12) serves as a "male" component mounted in the apparatus and the bottom arm (48) includes a "female" component for engaging the spindle (12). The spindle (12) is attached to an adjustable chain sprocket, a drive belt pulley, or a direct gear drive system, which, in turn, is coupled to the automatic door operator (4) drive system for the provision of torque. The spindle (12) is mounted in a tapered bearing on a base plate and is laterally secured within a bushing on a top plate (22), and additionally with a Delrin™ seal/bushing where the spindle exits the enclosure.

Spindle housing (14): An assembly comprising a top plate (22) with bushing (26), a bearing plate (20) with a tapered bearing, and front and back vertical support plates (16 and 18).

Mounting Sled (10): A structural support to which the spindle housing (14), door operating apparatus, and automatic operator (4) system are attached. The mounting sled (10) may be mounted into the enclosure (8) together with all attachments and reposition therein, if repositioning mechanisms are provided.

Door Arm (48): A structure or member attached to a door (2) and capable of being coupled to a spindle (12) for transmitting torque from the spindle (12) to the door (2). The door arm (48) includes a female bottom having any of several conventional designs to which the spindle (12) must be adapted for coupling.

What is claimed is:

1. A retrofit conversion kit with longitudinal adjustment for coupling an automatic door operator to a door for operating the door from a sub-floor stratum or from an above door position, the conversion kit comprising:

an enclosure containing the automatic door operator, the enclosure anchored within the sub-floor stratum or secured in the above door position, and having a conformation with a longitudinal dimension, the longitudinal dimension extending in a horizontal direction from a first end of the enclosure to a second end of the enclosure;

a spindle rotationally engaging the automatic door operator within the enclosure and vertically and rotationally engaging the door both to provide vertical support to the door and to transmit torque from the automatic door operator to the door;

a spindle housing supporting the spindle; and a sled enclosable within the enclosure, the sled securing the automatic door operator and the spindle housing therein, the sled having a first end orienting with the first end of the enclosure and a second end orienting with the second end of the enclosure, the spindle housing being attached proximal to first end of the sled and the automatic door operator being attached proximal to the second end of the sled, the sled being slideably securable within the longitudinal dimension of the enclosure such that the longitudinal position of the spindle may be adjusted.

2. A retrofit conversion kit with longitudinal adjustment for coupling an automatic door operator to a door for operating the door from a sub-floor stratum or from an above door position, the conversion kit comprising:

an enclosure for containing the automatic door operator, the enclosure being anchorable within the sub-floor stratum or securable in the above door position, and having a conformation with a longitudinal dimension, the longitudinal dimension extending in a horizontal direction from a first end of the enclosure to a second end of the enclosure;

a spindle adapted for rotationally engaging the automatic door operator within the enclosure and for vertically and rotationally engaging the door both for providing vertical support to the door and for transmitting torque from the automatic door operator to the door;

a spindle housing for supporting the spindle;

a sled enclosable within the enclosure for securing the automatic door operator and the spindle housing therein, the sled having a first end for orienting with the first end of the enclosure and a second end for orienting with the second end of the enclosure, the spindle housing being attached proximal to first end of the sled and the automatic door operator being attached proximal to the second end of the sled, the sled being slideably securable within the longitudinal dimension of the enclosure for adjusting the longitudinal position of the spindle;

an optional shim selected from a group of variably sized shims for wedging between the spindle housing and the first end of the longitudinal dimension of the enclosure; and a longitudinal adjustment rod attached to the sled and having an adjustable length for contacting the second end of the longitudinal dimension of the enclosure;

whereby the longitudinal position of the sled and of the attached spindle housing and the spindle borne thereon being secured within the enclosure by selecting one of the optional shims of desired size, wedging the shim between the spindle housing and the first end of the longitudinal dimension of the enclosure, and then adjusting the length of the longitudinal adjustment rod for contacting the second end of the longitudinal dimension of the enclosure and tightening the spindle housing against the shim and the first end of the longitudinal dimension of the enclosure.

3. A retrofit conversion kit with lateral adjustment for coupling an automatic door operator to a door for operating the door from a sub-floor stratum, the automatic door operator being of a type that is designed for operation from a position other than the sub-floor stratum, the conversion kit comprising:

an enclosure containing the automatic door operator, the enclosure anchored within the sub-floor stratum and having a conformation with a lateral dimension, the lateral dimension extending in a horizontal direction from a first side of the enclosure to a second side of the enclosure;

a spindle rotationally engaging the automatic door operator within the enclosure and vertically and rotationally engaging the door both to provide vertical support to the door and to transmit torque from the automatic door operator to the door;

a spindle housing supporting the spindle; and a sled enclosable within the enclosure, the sled securing the automatic door operator and the spindle housing therein, the sled having a first side corresponding the first side of the enclosure and a second side corresponding the second side of the enclosure, the spindle housing being attached to the sled, the sled being slideably securable within the lateral dimension of the enclosure such that the spindle may be laterally adjusted.

4. A retrofit conversion kit with lateral adjustment for coupling an automatic door operator to a door for operating the door from a sub-floor stratum, the automatic door operator being of a type that is designed for operation from a position other than the sub-floor stratum, the conversion kit comprising:

an enclosure for containing the automatic door operator, the enclosure being anchorable within the sub-floor stratum and having a conformation with a lateral dimension, the lateral dimension extending in a horizontal direction from a first side of the enclosure to a second side of the enclosure;

a spindle adapted for rotationally engaging the automatic door operator within the enclosure and for vertically and rotationally engaging the door both for providing vertical support to the door and for transmitting torque from the automatic door operator to the door;

a spindle housing for supporting the spindle;

a sled enclosable within the enclosure for securing the automatic door operator and the spindle housing therein, the sled having a first side corresponding the first side of the enclosure and a second side corresponding the second side of the enclosure, the spindle housing being attached to the sled, the sled being slideably securable within the lateral dimension of the enclosure for lateral adjustment of the spindle;

a first lateral adjustment screw;

a second lateral adjustment screw;

the top plate defining a first threaded screw hole adapted for accepting the first lateral adjustment screw;

the top plate defining a second threaded screw hole adapted for accepting the second lateral adjustment screw;

the first lateral adjustment screw, when screwed into the first screw hole being adapted for contacting the first side of the lateral dimension of the enclosure; and the second lateral adjustment screw, when screwed into the second screw hole being adapted for contacting the second side of the lateral dimension of the enclosure;

whereby the lateral position of the sled, the spindle housing and the spindle borne thereon being secured within the enclosure by adjustment of the first and second lateral adjustment screws.

* * * * *

UNITED STATES PATENT AND TRADEMARK OFFICE

CERTIFICATE OF CORRECTION

PATENT NO. : 8,375,636 B2
APPLICATION NO. : 13/314543
DATED : February 19, 2013
INVENTOR(S) : Nixon It is certified that error appears in the above-identified patent and that said Letters Patent is hereby corrected as shown below:

In the Specification

Column 2, Line 23
"(To ax is registered ..." should read "(Tormax is a registered..."

Column 7, Line 65
"alien" should read "allen"

Signed and Sealed this
Second Day of September, 2014

Michelle K. Lee

Michelle K. Lee
*Deputy Director of the United States Patent and Trademark Office*